US007871022B1

(12) United States Patent
Plyler

(10) Patent No.: US 7,871,022 B1
(45) Date of Patent: Jan. 18, 2011

(54) POSITIONABLE MISTER ASSEMBLY

(76) Inventor: Mark Franklin Plyler, 14151 SW. 146 Ter., Miami, FL (US) 33186

( * ) Notice: Subject to any disclaimer, the term of this patent is extended or adjusted under 35 U.S.C. 154(b) by 234 days.

(21) Appl. No.: 12/157,899

(22) Filed: Jun. 13, 2008

Related U.S. Application Data

(60) Provisional application No. 60/934,567, filed on Jun. 14, 2007.

(51) Int. Cl.
*B05B 15/08* (2006.01)

(52) U.S. Cl. ..... 239/588; 239/532

(58) Field of Classification Search ..... 239/588, 239/451, 455–458, 587.1–587.6, 289, 525, 239/531, 532; 261/28, 30, 116
See application file for complete search history.

(56) References Cited

U.S. PATENT DOCUMENTS

| | | | | |
|---|---|---|---|---|
| 1,058,566 | A | 4/1913 | Dunlap | |
| 2,403,430 | A | 7/1946 | Andrews et al. | |
| 3,563,461 | A | 2/1971 | Cole, Jr. | |
| 3,599,917 | A | 8/1971 | Schwartz | |
| 3,825,186 | A | 7/1974 | Heenan et al. | |
| 4,548,357 | A | 10/1985 | Schmidt | |
| 4,925,099 | A | 5/1990 | Owen | |
| 4,934,001 | A | 6/1990 | Landreth | |
| 5,099,602 | A | 3/1992 | Arnold, Sr. et al. | |
| 5,121,882 | A | 6/1992 | Skidmore | |
| 5,732,881 | A | 3/1998 | Wolter | |
| 6,065,693 | A | 5/2000 | Lukas | |
| 6,257,501 | B1 * | 7/2001 | Roach et al. | 239/289 |
| 6,622,427 | B2 | 9/2003 | Breitner | |
| 6,786,701 | B1 * | 9/2004 | Huang et al. | 417/199.1 |
| 7,033,673 | B2 * | 4/2006 | Wiedemann et al. | 428/447 |
| 7,210,637 | B1 | 5/2007 | Johnson | |
| 2005/0172987 | A1 * | 8/2005 | Byrnes | 135/33.5 |

* cited by examiner

*Primary Examiner*—Davis Hwu
(74) *Attorney, Agent, or Firm*—Malloy & Malloy, P.A.

(57) ABSTRACT

A positionable mister assembly comprises at least one nozzle structured to disperse an amount of fluid delivered from a fluid supply in the form of a mist. The positionable mister assembly includes a primary positioning portion comprising a conduit member and being structured to interconnect to a fluid supply. A secondary positioning portion is disposed in a fluid communicating relation with the primary positioning portion wherein the secondary positioning portion includes a mister supply member to which the at least one nozzle is mounted. The positionable mister assembly also includes a support portion structured to support at least the primary positioning portion in a plurality of operative orientations. In at least one embodiment the primary positioning portion, secondary positioning portion, and support portion of the positionable mister assembly are structured to be selectively interconnected to one another, allowing for a variety of configurations of the positionable mister assembly.

9 Claims, 6 Drawing Sheets

POSITIONABLE MISTER ASSEMBLY

CLAIM OF PRIORITY

The present application is based on and a claim of priority is made under 35 U.S.C. Section 119(e) to the provisional patent application that is currently pending in the U.S. Patent and Trademark Office, namely, U.S. Application Ser. No. 60/934,567 having a filing date of Jun. 14, 2007, and which is incorporated in its entirety herein by reference.

BACKGROUND

1. Field of the Invention

The present disclosure is directed to positionable mister assembly that is readily disposable into any of a plurality of operative misting orientations to provide irrigation as well as a source of cooling for persons and/or animals in a misting environment.

2. Description of the Related Art

Among the many challenges facing the world in view of limited natural resources, is our consumption of water, which is used not only for drinking purposes, but for sanitation, irrigation, as well as for recreational purposes. A number of devices have been developed to at least somewhat limit consumption of this valuable resource, such as low flow shower heads and low capacity toilets, as well as the more recent trend in the reuse of treated wastewater, at least for irrigation purposes.

One area of particular concern, however, is localized consumption of water for various purposes, such as, watering trees, plants, and lawns, as well as for cooling people and pets in the summer heat. A number of devices have been developed for specific purposes, such as irrigation of trees, both for purposes of providing necessary amounts of water for growth as well as freeze protection; for portable showers; and for cooling off while sunbathing.

None of the existing devices, however, contemplate use for a variety of purposes, thus requiring a user to obtain a specialized device for each particular watering task. As such, it would be desirable to provide a device which is readily positionable in an environment in which an amount of water must be delivered, which can be utilized for a variety of watering tasks. Further, it would be desirable for such a device to minimize the volume of water required to fulfill the watering needs by dispersing water in a fine mist in lieu of higher flow watering techniques. More in particular, it would be beneficial to provide a device which is readily disposable into a plurality of operative orientations in a watering or misting environment, ranging from elevated orientations, to permit watering of trees and plants or to cool an area for people and/or animals, to orientations proximate the ground, thereby allowing a user to water an area of lawn, flowerbed, garden, etc. It would further be helpful if such a device comprises a plurality of interconnecting portions such that a single device is disposable into a plurality of orientations to facilitate its use in a wide array of watering tasks. It would also be desirable for such a device to include an exterior finish corresponding to a watering or misting environment, such that the device is at least partially camouflaged when disposed therein, so as not to detract from the appearance of the environment. This is particularly useful when such a device is utilized in a well landscaped yard, park, or other such environment.

SUMMARY

The present disclosure is directed to a positionable mister assembly structured to facilitate irrigation of vegetation as well as to provide a source of cooling for persons and animals. The positionable mister assembly comprises a primary positioning portion having a fluid inlet and a fluid outlet wherein the fluid inlet is structured to be interconnected to a fluid supply including, but not limited to, a standard outdoor garden hose tap or faucet. In at least one embodiment, the positionable mister assembly further comprises a secondary positioning portion which is disposed in a fluid communicating relation with the primary positioning portion. More in particular, the secondary positioning portion includes a mister supply member having at least one nozzle disposed proximate a distal end thereof, wherein the nozzle is structured to disperse an amount of fluid delivered thereto from the fluid supply in the form of a mist.

The positionable mister assembly, in at least one embodiment, also includes a support portion disposed in an operative relation with the primary positioning portion and being structured to support at least the primary positioning portion in any of a plurality of operative orientations. More in particular, in one embodiment, the support portion comprises at least one support member disposed in said operative relation with the primary positioning portion. In one further embodiment, the support portion comprises at least one support member disposed in an operative relation with the primary positioning portion and structured to support at least the primary positioning portion in any of a plurality of operative orientations relative to an area of ground in a misting environment, wherein at least one orientation is an elevated orientation relative to the area of ground in the misting environment.

In one alternative embodiment, the positionable mister assembly comprises a positionable anchor portion which is structured to permit the primary positioning portion of the positionable mister assembly to be disposed in an anchored orientation relative to an area of ground in a misting environment.

In yet one further embodiment, and in accordance with the present disclosure, the positionable mister assembly comprises an exterior finish, wherein the exterior finish corresponds to the misting environment and is structured to at least partially camouflage the positionable mister assembly when it is operatively disposed in said misting environment.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As before, the present disclosure is directed to a positionable mister assembly generally as shown at 10 throughout the figures. The positionable mister assembly 10 is structured to be readily movable throughout a misting environment, such as, by way of example only, a residential yard, garden, arboretum, park, field, etc., both quickly and easily. Further, the positionable mister assembly 10 is structured to disperse an amount of fluid, for example, irrigation water, to the misting environment in the form of a mist. As used throughout the present disclosure, the term "mist" shall mean a plurality of droplets of water or other liquid dispersed into the air.

Figure 1:
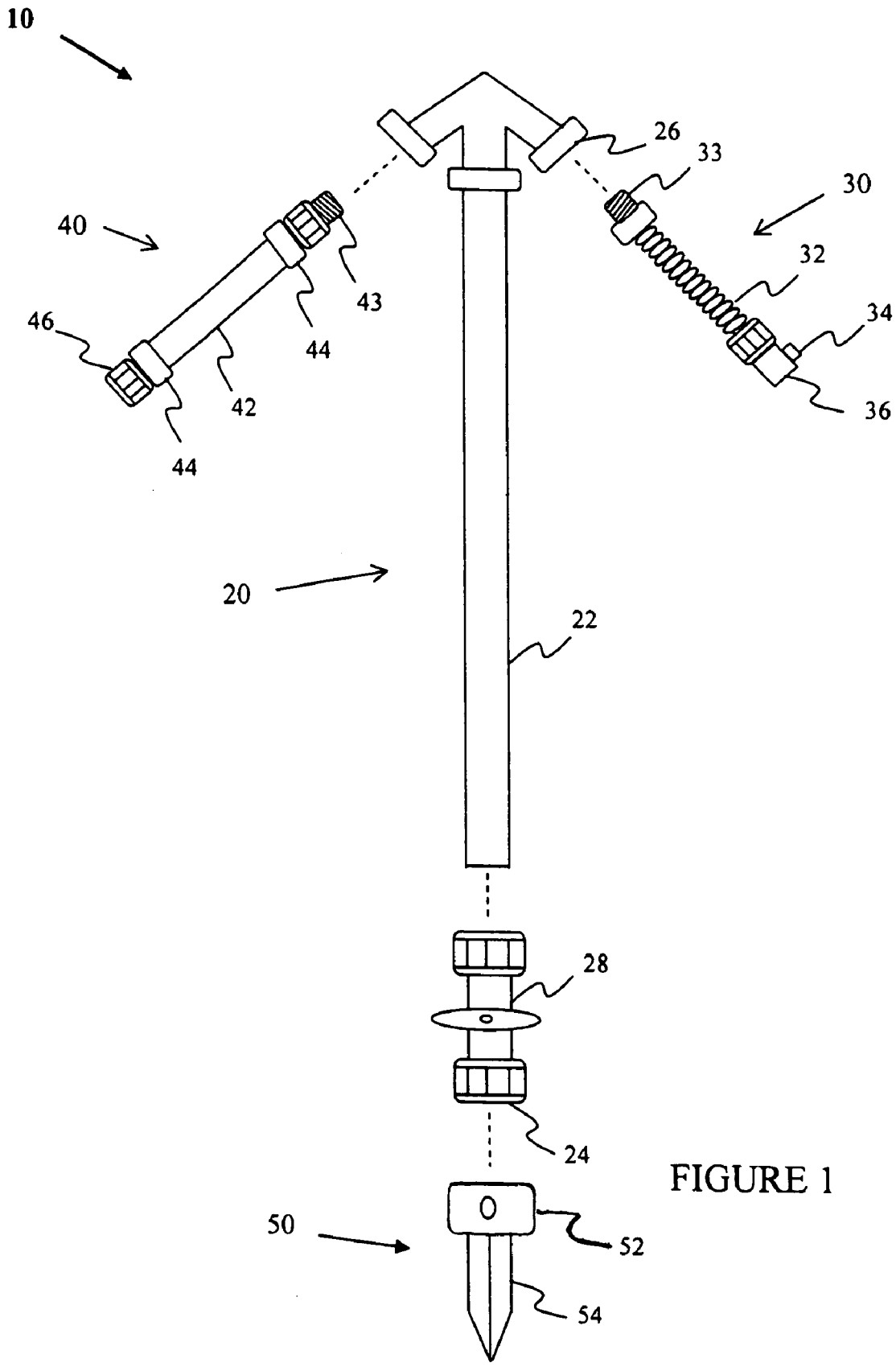
FIG. 1 is an exploded view of one embodiment of a positionable mister assembly in accordance with the present disclosure.

A positionable mister assembly 10 in accordance with the present disclosure includes a primary positioning portion 20 having a fluid inlet 24 and a fluid outlet 26, such as shown in FIG. 1. The primary positioning portion 20, in at least one embodiment, includes a conduit member 22 having the fluid inlet 24 and fluid outlet 26 interconnected thereto. The fluid inlet 24 of the primary positioning portion 20 is structured to allow interconnection of the positionable mister assembly 10 to a fluid supply. As stated above, the fluid supply may include a standard household faucet or tap and in particular, a standard faucet having a threaded hose bib connection structured for use with a standard garden hose. In at least one embodiment, the fluid inlet 24 of the primary positioning portion 20 comprises a standard hose bib type interconnection.

As further illustrated in FIG. 1, in at least one embodiment, the primary positioning portion 20 includes a flow control mechanism 28. The flow control mechanism 28 may comprise any of a number of types of valves, a ballcock, or other such mechanisms as are utilized to regulate flow of water or other liquids through conduit member 22. In at least one embodiment, the flow control mechanism 28 is structured to deliver an amount of fluid from the fluid supply to the conduit member 22 of the primary positioning portion 20, and in at least one further embodiment, the flow control mechanism 28 is structured to permit adjustment of the amount of fluid delivered from the fluid supply over a broad range, i.e., from full flow to zero flow.

In accordance with the illustrative embodiment of FIG. 1, the positionable mister assembly 10 further comprises a secondary positioning portion 30 which is disposed in a fluid communicating relation with the primary positioning portion 20. Specifically, and as illustrated in FIG. 1, the secondary positioning portion 30 comprises a mister supply member 32 having a proximal and distal end thereof. In at least one embodiment, the mister supply member 32 includes at least one nozzle 34 mounted to an endpiece 36 disposed proximate a distal end thereof. It will be further appreciated that the at least one nozzle 34 may be removably mounted to the endpiece 36, thereby allowing for replacement with a nozzle 34 providing different flow characteristics. In addition, a nozzle 34 may be temporarily removed from the endpiece 36 so as to temporarily allow unrestricted flow from the mister supply member 32, such as may be required in the field in certain applications. As illustrated in FIG. 1, in at least one embodiment, the mister supply member 32 comprises an elongated configuration. The at least one nozzle 34 is structured to disperse the amount of fluid delivered from the fluid supply through the conduit member 22 of the primary positioning portion 20 and into mister supply member 32, the amount of fluid thereafter being dispersed through the nozzle 34 as a mist.

Once again, and as disclosed above, as used herein the term "mist" shall mean a dispersion of a plurality of droplets of water or other liquid into the air. More in particular, in at least one embodiment, the plurality of droplets dispersed into the air from a nozzle 34 or other such dispersion structure in accordance with the present disclosure initially range in size from about fifty to one-hundred microns, such as via a Series EXL-Fogger manufactured by DIG Irrigation Products of Vista, Calif., which provides flow rates in the range of about 1 to 3 gallons per hour. As another example, the positionable mister assembly 10 in accordance with the present invention may employ a Fogger Mister, Model Number 7750BB, also manufactured by DIG Irrigation Products of Vista, Calif., as a nozzle 34, which provides slightly higher flow rates ranging from about 6 to 7 gallons per hour.

Figure 5:
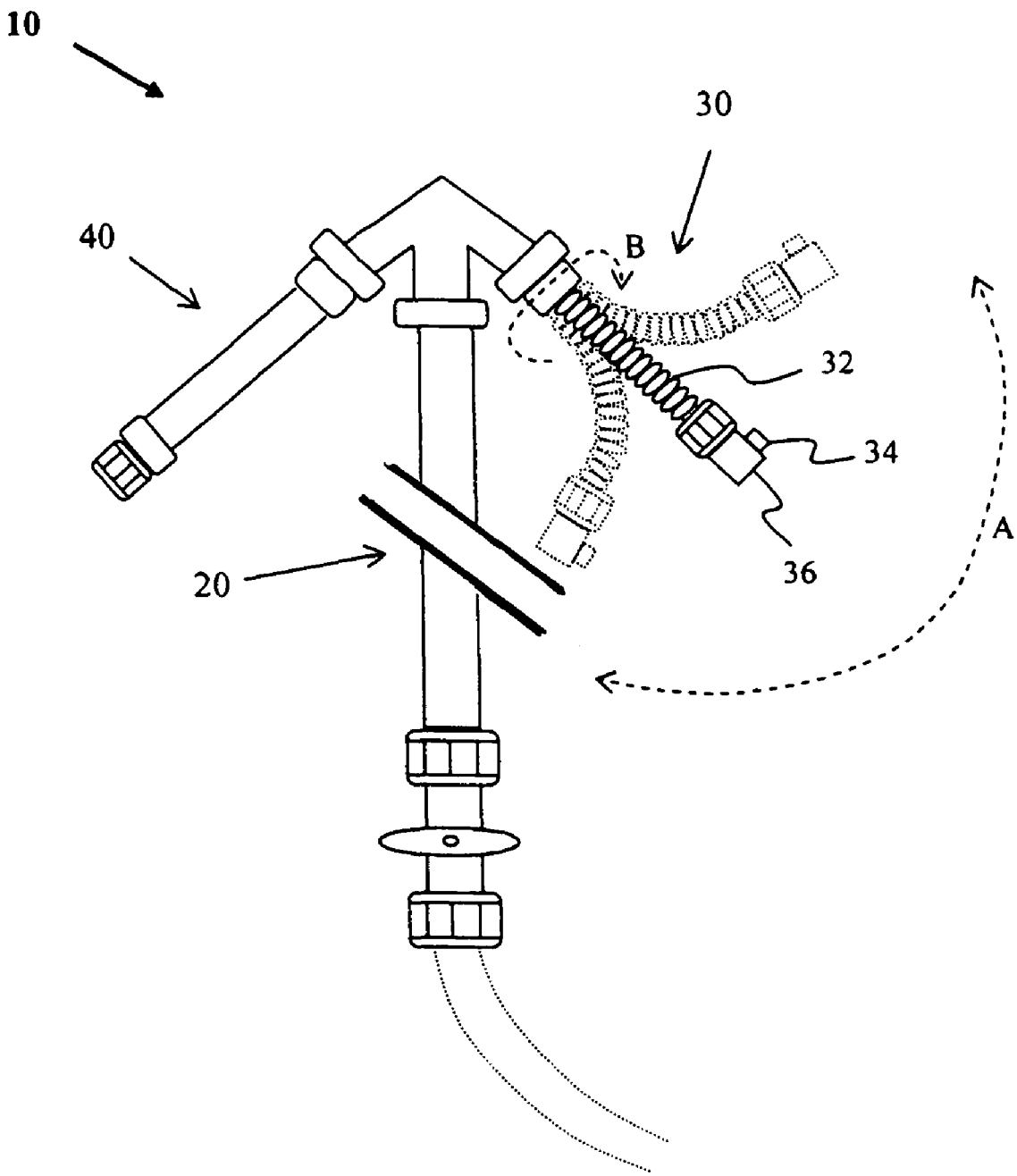
FIG. 5 is a perspective view illustrative of one embodiment of a mister supply member disposable into a plurality of misting configurations.

The secondary positioning portion 30 in accordance with the present disclosure is further and specifically structured to allow selective disposition of at least one nozzle 34 into a plurality of misting orientations. More in particular, and as illustrated best in FIG. 5, the mister supply member 32 of the secondary positioning portion 30 comprises a flexible construction disposable into any of a plurality of misting configurations to facilitate the selective disposition of nozzle 34 into each of a plurality of misting orientations, such as is demonstrated by the arcuate path shown by reference character "A". FIG. 5 is illustrative of the flexibility of mister supply member 32 along the plane of the page, i.e., two dimensional, however, it will be understood and appreciated by one of ordinary skill in the art that a mister supply member 32 comprising a flexible construction may be disposed into and out of planes extending outwardly from the plane of the page thereby providing an approximately hemispherical range of misting orientations into which nozzle 34 may be disposed. Thus, the flexible construction of the mister supply member 32 is structured to permit a user to dispose the mister supply member 32 into each of a plurality of operative misting configurations. As yet another example, the flexible construction of the mister supply member 32 allows a user to dispose the mister supply member 32 into a substantially horizontal misting configuration, as well as into either a substantially vertical orientation, being directed either skyward, or directly towards the ground in a misting environment.

Additionally, in one further embodiment, the mister supply member 32 is further structured such that it will retain an operative misting configuration in which it is oriented by a user, until such time as it is reoriented by the user or otherwise. That is to say, the flexible construction of the mister supply member 32 comprises sufficient rigidity such that the simple force of a fluid being dispersed therethrough will not substantially alter an operative configuration into which the mister supply member 32 is purposefully and selectively oriented into by a user. Rather, a subsequent, purposeful and selective orientation of the mister supply member 32 is required in order to alter its operative configuration.

Figure 6:
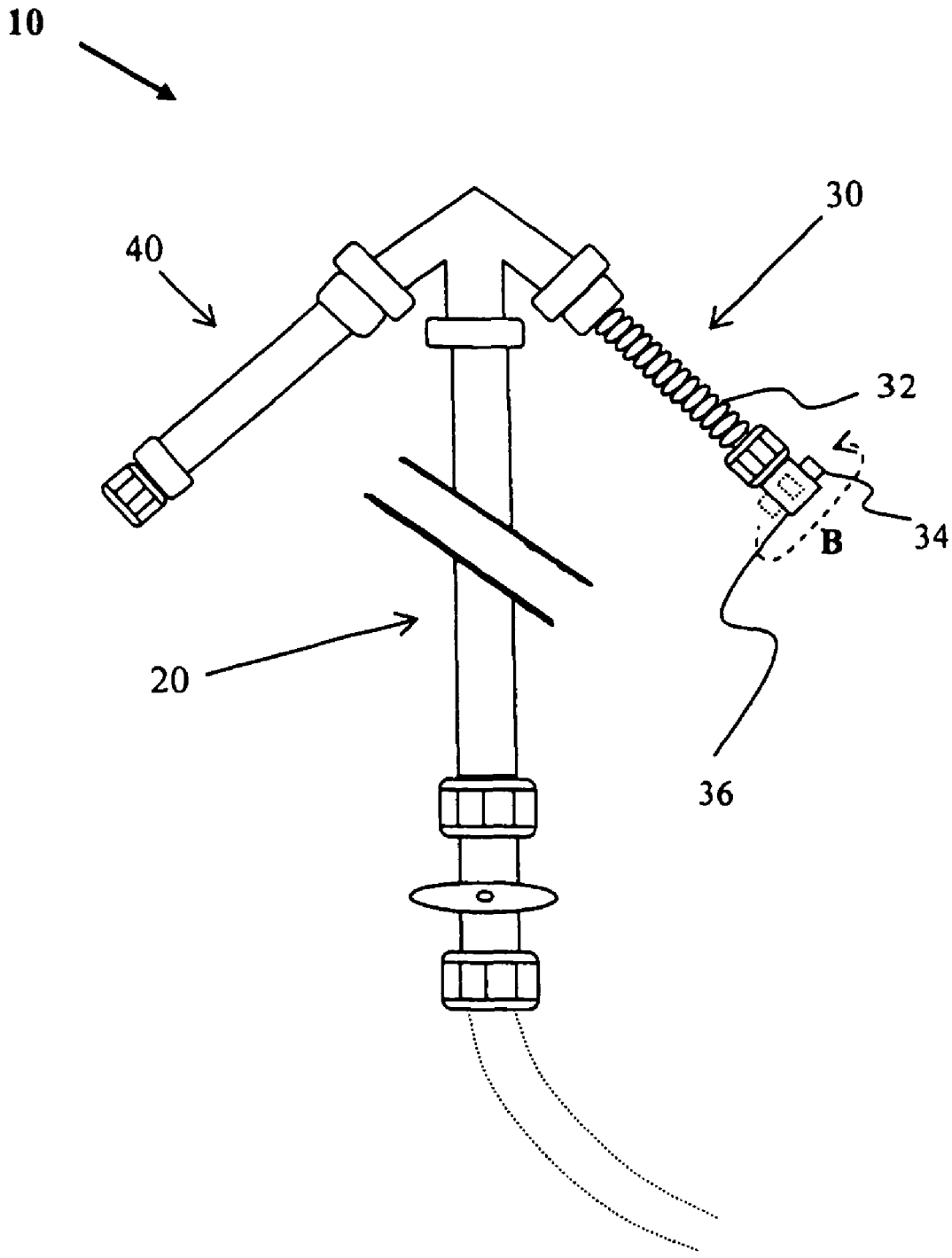
FIG. 6 is a perspective view illustrative of one embodiment of a nozzle disposable into a plurality of misting orientations.

Looking next to FIG. 6, it may be seen that in at least one embodiment, endpiece 36 is movably mounted to the mister supply member 32. More specifically, and as shown in the illustrative embodiment of FIG. 6, the endpiece 36 is rotatably mounted to the distal end of the mister supply member 32 and is rotational thereabout. As demonstrated by the circular path shown by reference character "B", in at least one embodiment, the endpiece 36 is rotatable a full 360° about the distal end of the mister supply member 32. Thus, as will be appreciated from the foregoing, the combination of a mister supply member 32 comprising a flexible construction and a movably mounted endpiece 36 to a distal end thereof provides a substantially unlimited array of misting orientations into which at least one nozzle 34 may be disposed. As such, a single positionable mister assembly 10 in accordance with the present disclosure can be utilized to deliver an amount of fluid as a mist to essentially any area of a misting environment.

Figure 2:
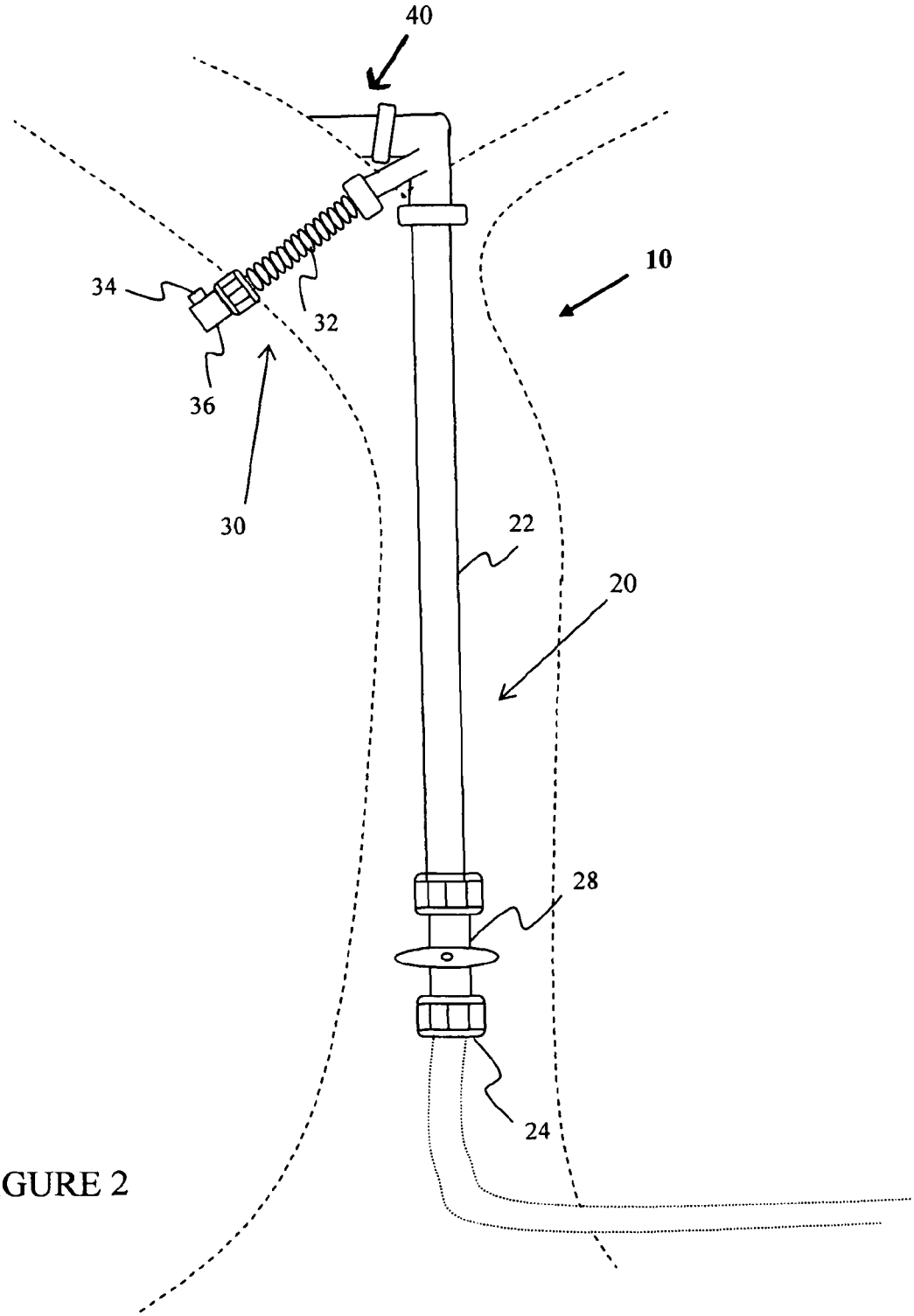
FIG. 2 is a perspective view of a positionable mister assembly in accordance with the present disclosure disposed in an elevated orientation relative to an area of ground in a misting environment.

With reference once again to FIG. 1, the positionable mister assembly 10 in accordance with the present disclosure further comprises a support portion 40 disposed in an operative relation with the primary positioning portion 20. More in particular, the support portion 40 is structured to support at least the primary positioning portion 20 in any of a plurality of operative orientations. In the illustrative embodiment of FIG. 2, support portion 40 is structured to support primary positioning portion 20 in an essentially vertical and elevated orientation relative to an area of ground in the misting environment. Specifically, the illustrative embodiment of FIG. 2 demonstrates support portion 40 supporting primary positioning portion 20 and secondary positioning portion 30 in an essentially vertical and elevated orientation adjacent the trunk of a tree. Of course, it will be appreciated that a positionable mister assembly 10 in accordance with the present disclosure may be disposed in such a vertical and elevated orientation adjacent a house, shed, barn, or other such structure by positioning the support portion 40 along the edge of the roof, the gutter, or other such structure as may be attached or adjacent the house, shed, barn, etc.

In at least one further embodiment, the support portion 40 comprises at least one support stop 44 structured to facilitate maintaining the support portion 40, and thus, the positionable mister assembly 10 itself, in position. The support stop 44 is structured to at least partially encircle at least a section of the support portion 40 and comprises a generally larger dimension such that it will abut against and "stop" the support member 42 from sliding off and disengaging from an elevated location, such as a tree truck, fence, rooftop, etc. As illustrated in FIG. 1, the support portion 40 may comprise a plurality of support stops 44 comprising substantially annular configurations and being disposed in a spaced apart relation along opposite ends of support member 42, thereby providing "stops" in both directions along the support member 42 to facilitate maintaining the positionable mister assembly 10 in position, whether the support portion 40 is disposed in an elevated orientation or in position along the ground in a misting environment. In yet one further embodiment, one or more support stop 44 may be mounted to other "portions" of the positionable mister assembly 10, such as, along the primary positioning portion 20, secondary positioning portion 30, or both.

Figure 3:
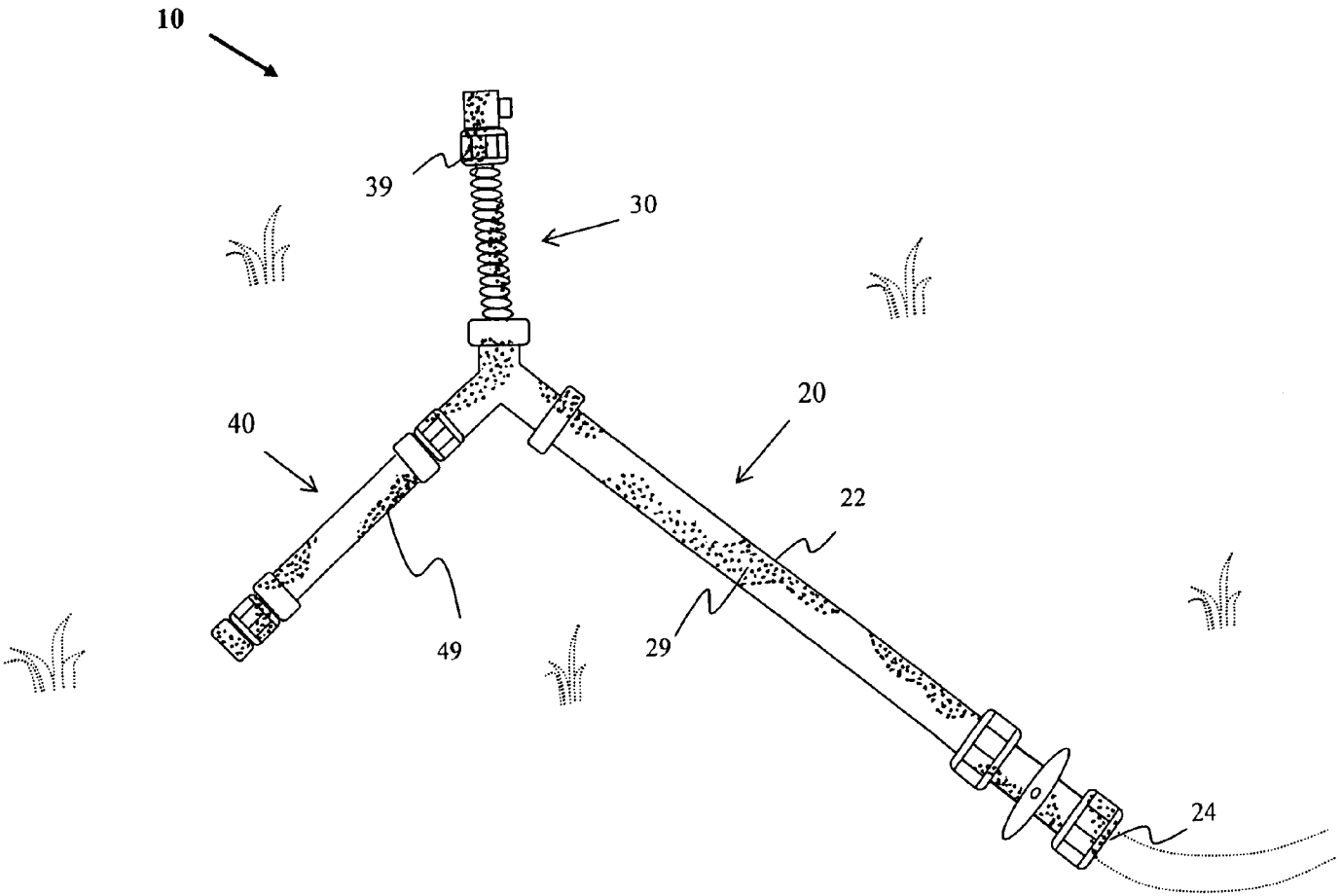
FIG. 3 is a perspective view of a positionable mister assembly in accordance with the present disclosure disposed in a substantially horizontal orientation relative to an area of ground in a misting environment.

Looking next to FIG. 3, another illustrative embodiment of the positionable mister assembly 10 in accordance with the present disclosure is shown wherein a support portion 40 is structured and disposed such that the primary positioning portion 20 is disposed in a substantially horizontal orientation along an area of ground in a misting environment. Further, FIG. 3 illustrates the secondary positioning portion 30 disposed in a substantially upright vertical orientation relative to the area of ground in the misting environment, thereby permitting selective disposition of nozzle 34 into any of a plurality of misting orientations immediately proximate the area of ground in the misting environment.

It will be appreciated from the foregoing that in at least one embodiment, the primary positioning portion 20, the secondary positioning portion 30, and the support portion 40 of the positionable mister assembly 10 are structured to be selectively interconnected to one another, allowing for a virtually unlimited variety of configurations into which the positionable mister assembly 10 may be disposed.

FIG. 3 is also illustrative of an embodiment of a positionable mister assembly 10 in accordance with the present disclosure wherein at least one of the portions comprises an exterior finish which corresponds to the misting environment. More in particular, in at least one embodiment, one or more of the primary positioning portion 20, secondary positioning portion 30, and support portion 40 of the positionable mister assembly 10 comprise an exterior finish, namely, primary exterior finish 29, secondary exterior finish 39, and/or support exterior finish 49, respectively, structured to at least partially camouflage the positionable mister assembly 10 when disposed in a misting environment, such as being disposed along the ground, as illustrated in FIG. 3. In yet another alternate embodiment, the exterior finish of one or more portions of the positionable mister assembly 10 may be purely decorative, such as, color coordinated with a house or other structure proximate a misting environment, embodying a party motif for a holiday or other special occasion, etc.

As one example, the primary positioning portion 20 may comprise a primary exterior finish 29 corresponding to the misting environment wherein the primary exterior finish 29 is structured to at least partially camouflage the positionable mister assembly 10 within the misting environment. In one further embodiment, the secondary positioning portion 30 may comprise a secondary exterior finish 39 which is also structured to correspond to the misting environment so as to further camouflage the positionable mister assembly 10 when it is disposed in said misting environment. As in the illustrated environment of FIG. 3, the support portion 40 may also comprise a support exterior finish 49 which also corresponds to the misting environment to further facilitate camouflage of the entire positionable mister assembly 10 when it is disposed in an operative orientation in the corresponding misting environment. It will be appreciated by persons of ordinary skill in the art that although FIG. 3 is illustrative of an environment wherein each of the primary positioning portion 20, secondary positioning portion 30, and support portion 40, each comprise an exterior finish, namely, a primary exterior finish 29, a secondary exterior finish 39, and a support exterior finish 49, to facilitate camouflage of the positionable mister assembly 10, it remains within the scope and intent of the present disclosure for the positionable mister assembly 10 to comprise only one portion having an exterior finish to camouflage the assembly 10, in combination with one or more other portions not having such an exterior finish.

Figure 4:
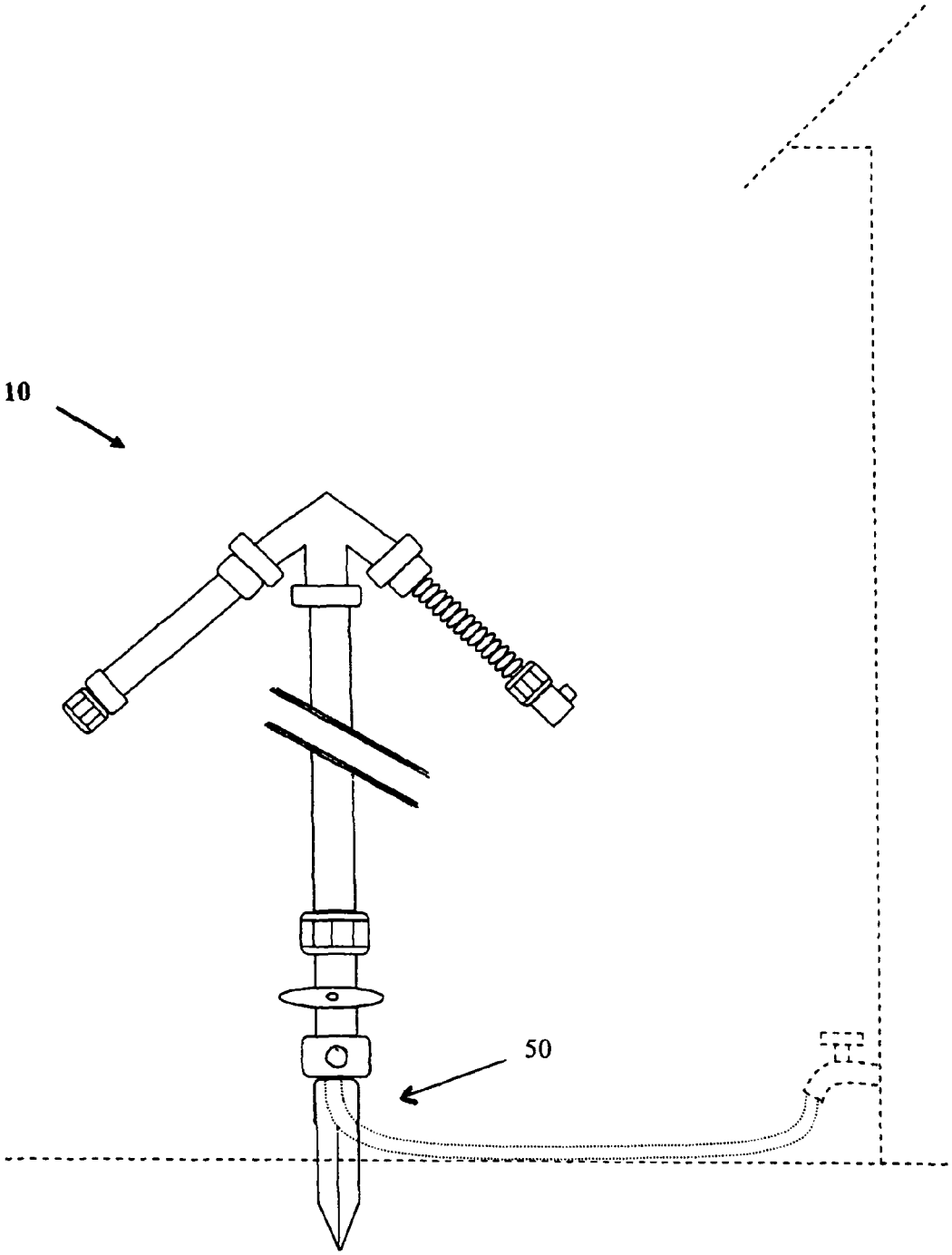
FIG. 4 is a perspective view of a positionable mister assembly in accordance with the present disclosure disposed in an anchored orientation relative to an area of ground in a misting environment.

FIG. 4 is illustrative of an embodiment of a positionable mister assembly 10 in accordance with the present disclosure further comprising a positionable anchor portion 50, also represented in FIG. 1, structured to positionably anchor at least a primary positioning portion 20 in a free standing and operative orientation relative to an area of ground in a misting environment, as illustrated therein. The positionable anchor portion 50 comprises an engagement member 52 structured to removably interconnect at least a portion of said primary positioning portion 20 to the positionable anchor portion 50. The engagement member 52 may include any of a plurality of temporary and/or releasable mechanical attachment mechanisms. For example, the engagement member 52 may simply comprise a collar having a set screw therethrough such that when the set screw is tightened it engages the primary positioning portion 20 and removably interconnects it to the positionable anchor portion 50. In another embodiment, the engagement member 52 comprises a collar having an elongated strap member structured to wrap around at least a section of the primary positioning portion 20 to removably interconnect it to the positionable anchor portion 50. In this embodiment, the strap member may comprise hook-and-loop fasteners, or a standard buckle and belt hole configuration, or other quick release mechanical fasteners such as snaps, buttons, hooks, etc. In yet one further embodiment, by way of example, engagement member 52 may comprise a collar having an interior comprising an amount of a resilient material such that the primary positioning portion 10 may be releasable retained therein by way of friction fit.

The positionable anchor portion 50 further comprises an anchor member 54 which is structured to be temporarily and securely mounted into an area of ground in the misting environment. In this regard, the anchor member 54, in at least one embodiment, comprises a pointed, spade like configuration to facilitate disposition into an area of ground in the misting environment.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A positionable mister assembly comprising:

a primary positioning portion comprising a fluid inlet and a fluid outlet, said fluid inlet structured to interconnect to a fluid supply, a secondary positioning portion disposed in a fluid communicating relation with said primary positioning portion, said secondary positioning portion comprising a mister supply member having at least one nozzle disposed at a distal end thereof, said nozzle structured to disperse an amount of fluid delivered from the fluid supply as a mist, said secondary positioning portion further structured to allow selective disposition of said nozzle into a plurality of misting orientations, said mister supply member comprising a flexible construction to facilitate said selective disposition of said nozzle into each of said plurality of misting orientations, a support portion disposed in an operative relation with said primary positioning portion and structured to support at least said primary positioning portion in each of a plurality of operative orientations, and said support portion comprising a support member disposed in an outwardly extending relation from said primary positioning portion and having at least one support stop attached thereto, said support member structured to support said primary positioning member in different ones of each of said plurality of operative orientations.

2. The positionable mister assembly as recited in claim 1 wherein said flexible construction of said mister supply member is structured to permit a user to orient said mister supply member into a plurality of operative configurations.

3. The positionable mister assembly as recited in claim 2 wherein said mister supply member is further structured to retain said operative configuration.

4. A positionable mister assembly comprising:

a primary positioning portion comprising a conduit member having a fluid inlet and a fluid outlet, said fluid inlet structured to interconnect to a fluid supply, said conduit member comprising a primary exterior finish, wherein said primary exterior finish corresponds to a misting environment to at least partially camouflage said positionable mister assembly when disposed in the misting environment, a secondary positioning portion disposed in a fluid communicating relation with said primary positioning portion, said secondary positioning portion comprising a mister supply member and at least one nozzle, said nozzle structured to disperse an amount of fluid delivered from the fluid supply as a mist, a support portion comprising at least one support member disposed in an operative relation with said primary positioning portion and structured to support at least said primary positioning portion in any of a plurality of operative orientations relative to an area of ground in a misting environment, and a positionable anchor portion structured to permit said primary positioning portion to be positionably anchored in an elevated orientation relative to the area of ground in the misting environment.

5. The positionable mister assembly as recited in claim 4 wherein said positionable anchor portion further comprises an engagement member structured to removably interconnect at least said primary support portion to said positionable anchor portion.

6. The positionable mister assembly as recited in claim 5 wherein said positionable anchor portion comprises an anchor member structured to be temporarily yet securely mounted into the area of ground in the misting environment.

7. A positionable mister assembly comprising:

a primary positioning portion comprising a conduit member having a fluid inlet and a fluid outlet, said fluid inlet structured be interconnect to a fluid supply, said primary positioning portion further comprising a flow control mechanism structured to control an amount of fluid delivered from the fluid supply, a secondary positioning portion disposed in a fluid communicating relation with said fluid outlet of said primary positioning portion, said secondary positioning portion comprising a mister supply member having a proximal end and a distal end, and an endpiece movably interconnected to said distal end of said mister supply member, at least one nozzle mounted to said endpiece, said nozzle structured to disperse the amount of fluid delivered from the fluid supply as a mist, said secondary positioning portion structured to allow selective disposition of said nozzle into a plurality of misting orientations, said mister supply member comprising a flexible construction to facilitate said selective disposition of said nozzle into each of said plurality of misting orientations, said movable interconnection of said endpiece to said distal end of said mister supply member further facilitating said selective disposition of said nozzle into said plurality of misting orientations, a support portion comprising at least one support member disposed in an operative relation with said primary positioning portion, said support portion structured to permit at least said primary positioning member to be positionably supported in any of a plurality of operative orientations relative to an area of ground in a misting environment, a positionable anchor portion structured to permit at least said primary positioning portion to be positionably anchored in a free standing elevated and operative orientation relative to the area of ground in the misting environment, said positionable anchor portion comprising an engagement member structured to removably interconnect said primary support portion to said positionable anchor portion, said positionable anchor portion comprises an anchor member structured to be temporarily yet securely mounted into the area of ground in the misting environment, and said conduit member comprises a primary exterior finish, wherein said primary exterior finish corresponds to the misting environment to at least partially camouflage said positionable mister assembly when disposed in the misting environment.

8. The positionable mister assembly as recited in claim 7 wherein said mister supply member comprises a secondary exterior finish, said secondary exterior finish corresponding to a misting environment to further camouflage said positionable mister assembly when disposed in the misting environment.

9. The positionable mister assembly as recited in claim 8 wherein said endpiece is rotatably interconnected to said distal end of said mister supply member, thereby providing a three-hundred and sixty degree range for positioning said nozzle relative to said mister supply member.

* * * * *

UNITED STATES PATENT AND TRADEMARK OFFICE

CERTIFICATE OF CORRECTION

PATENT NO. : 7,871,022 B1
APPLICATION NO. : 12/157899
DATED : January 18, 2011
INVENTOR(S) : Mark Franklin Plyler It is certified that error appears in the above-identified patent and that said Letters Patent is hereby corrected as shown below:

Claim 1, column 7, line 55, after positioning, delete “member” and insert therefor --portion--.
Claim 7, column 8, line 35, after structured, delete “be” and insert therefor --to--.
Claim 7, column 8, line 62, after positioning, delete “member” and insert therefor --portion--.
Claim 7, column 9, line 3, after primary, delete “support” and insert therefor --positioning--.

Signed and Sealed this
Twelfth Day of April, 2011

David J. Kappos

David J. Kappos
*Director of the United States Patent and Trademark Office*